US005385233A

United States Patent [19]

McKibben et al.

[11] Patent Number: 5,385,233

[45] Date of Patent: Jan. 31, 1995

[54] PORTABLE BULK STORAGE CONTAINER

[75] Inventors: Richard D. McKibben, Clarkston; Patrick M. McGraw, Flint; Charles Simpson, Holly, all of Mich.; Kenneth D. McKibben, Defiance, Ohio; Daniel D. Minor, Au Gres, Mich.

[73] Assignee: CMI International, Inc., Southfield, Mich.

[21] Appl. No.: 160,603

[22] Filed: Dec. 1, 1993

[51] Int. Cl.[6] ..... B65D 19/00

[52] U.S. Cl. ..... 206/386; 206/599; 220/571; 220/630; 108/51.1

[58] Field of Search ..... 206/386, 595, 596, 599; 220/571, 630, DIG. 6; 108/51.1

[56] References Cited

U.S. PATENT DOCUMENTS

| | | | |
|---|---|---|---|
| 2,664,219 | 12/1953 | Schmidt | 220/1.5 |
| 3,318,473 | 5/1967 | Jones et al. | 206/596 |
| 3,623,631 | 11/1971 | Ford | 206/596 |
| 3,951,295 | 4/1976 | Guenther | 220/9 F |
| 4,050,580 | 9/1977 | Wilson | 206/386 |
| 4,395,808 | 8/1983 | Ryan et al. | 108/51.1 |
| 4,609,120 | 9/1986 | Lauer et al. | 220/630 |
| 4,648,521 | 3/1987 | Thomas et al. | 220/1.5 |
| 4,746,034 | 5/1988 | Ata et al. | 222/143 |
| 4,782,973 | 11/1988 | Wiese | 220/68 |
| 4,785,958 | 11/1988 | Snyder | 220/5 A |
| 4,840,284 | 6/1989 | Snyder | 220/5 A |
| 5,071,028 | 12/1991 | Murphy | 220/601 |
| 5,111,937 | 5/1992 | Schutz | 206/386 |
| 5,156,268 | 10/1992 | Nichols | 206/386 |
| 5,226,558 | 7/1993 | Whitney | 206/571 |
| 5,259,509 | 11/1993 | Boal, Jr. et al. | 220/571 |

FOREIGN PATENT DOCUMENTS 428703 5/1935 United Kingdom .

OTHER PUBLICATIONS

Safety Tote-Tanks: Portable Bulk Storage Tanks for Liquid Products. Holly, Michigan: CMI-Schneible Company.

*Primary Examiner*—David T. Fidei

*Attorney, Agent, or Firm*—Reising, Ethington, Barnard, Perry & Milton

[57] ABSTRACT

A portable container 10 for containing liquids has a circular top wall portion 12, a circular exterior bottom wall portion 14, and a cylindrical side wall portion 16 extending vertically between the top wall portion 12 and exterior bottom wall portion 14. The container 10 includes a plurality of forklift tubes 18 attached to the exterior bottom wall portion 14 for receiving the forks 20 of a forklift vehicle 22. The side wall portion 16 has a drain opening 24 and a valve 26 disposed therein for draining the liquids from the container. The container 10 is characterized by an interior false bottom portion 30 abutting the side wall portion 16 and sloping downwardly toward the drain opening 24 for causing complete drainage of the liquids contained within the container 10.

4 Claims, 2 Drawing Sheets

PORTABLE BULK STORAGE CONTAINER

TECHNICAL FIELD

The subject invention relates to portable containers for transporting, storing, and dispensing liquids.

BACKGROUND OF THE INVENTION

Conventional 55-gallon drums are used to store liquids and can be transported from one location to another by using a wooden pallet which sits beneath the 55-gallon drum. A forklift vehicle having forks is used to pick up and move the pallet and the drum thereon. In many applications today, a portable liquid container of the type disclosed in U.S. Pat. No. 4,746,034 to Ata et. al. is used for moving and storing up to 500 gallons of liquid without the need of a pallet. The Ata portable liquid container includes a four-sided shell enclosed by a bottom wall and a top wall. The bottom wall is formed by four triangular portions sloping downwardly to a delivery opening. The top wall has an opening which is normally covered by a lid. Two lifting channels and a valve disposed within the delivery opening are located on the underside of the bottom wall. The container is designed to be stackable upon a second like container. Four legs attached to the bottom wall support the container at a height sufficient to clear the valve and lifting channels. The lifting channels are designed to receive the forks of a forklift vehicle so that the forklift vehicle can pick up and transport the portable container. The container includes a sloped bottom wall which assures that all the liquid within the container will drain from the container through the delivery opening without having to tilt or otherwise manipulate the container.

A few problems occur with such a portable liquid container, however. First, since the lifting channels and valve are both located on the underside of the bottom wall, the valve is very susceptible to damage by the forks of the forklift vehicle. Second, since the lifting channels do not abut the surface upon which the four legs rest, it is difficult for the forklift vehicle operator to properly line up the forks to insert them in the lifting channels. This "alignment requirement" compounds the likelihood of valve damage and/or shell damage. Finally, with the valve located on the underside of the bottom wall, the access valve is difficult to access.

The assignee of the present invention has solved the above mentioned problems by making and selling (for more than one year before the filing date of this application) a portable bulk storage tank for containing liquids having a drain opening and valve disposed therein which are located on the side wall or shell portion of the container instead of the bottom wall portion. Additionally, the side wall portion of this container includes an indentation for enclosing the drain opening and valve to thereby protect the valve from the forks of a forklift. Also, the container comprises a substantially flat exterior bottom wall portion and a plurality of forklift tubes attached thereto. A flat exterior bottom wall portion is needed so that the tubes can support the container in an upright position. The forklift tubes also act as legs upon which the container rests on a surface. The forklift tubes are designed to receive the forks of a forklift from more than one direction.

With the indentation and valve located on the side wall portion and the need for a substantially flat exterior bottom portion upon which the forklift tubes can rest, the liquid contained within the container cannot be completely drained from the valve without tipping the container. Since the valve is located above the exterior bottom wall portion, liquid lays on the surface of the exterior bottom wall portion especially in the areas or corners of the container between the walls of the indentation and the side wall portion. In other words, the liquid becomes trapped between the walls of the indentation and the side wall portion. Thus, a sloped false bottom is needed which directs the liquid away from these corners while also directing the liquid towards the drain opening.

SUMMARY OF THE INVENTION AND ADVANTAGES

A portable container for containing liquids comprises a top wall portion, an exterior bottom wall portion and a side wall portion extending vertically between the top wall portion and the exterior bottom wall portion. A plurality of forklift tubes are attached to the exterior bottom wall portion for receiving the forks of a forklift vehicle whereby the forklift vehicle is used to transport the portable container. The side wall portion has a drain opening and a valve disposed therein for draining the liquids from the container. The portable container is characterized by an interior false bottom portion abutting the side wall portion and sloping downwardly toward the drain opening for causing complete drainage of the liquids contained within the container.

The primary object/advantage of the present invention is to ensure the full drainage of the contents of a container having a drain opening and valve located on the side wall portion of the container without having to tilt the container.

A further object/advantage of the present invention is to ensure the full drainage of the contents of a container having a drain opening and valve positioned within an indentation located on the side wall portion of the container without having to tilt the container.

A further object/advantage of the invention is to provide forklift tubes for receiving the forks of a forklift vehicle from more than one direction.

A further object/advantage of the invention is to position the forklift tubes and drain opening so as to minimize damage to the valve and side wall portion caused by the forks of a forklift vehicle used to transport the portable container.

A further object/advantage of the invention is to use a portion of the container to enclose and thereby protect the valve of the container.

A further object/advantage of the invention is to provide a flat bottom surface for the container upon which the forklift tubes rest.

A further object/advantage of the invention is to provide forklift tubes which support the container upon a surface.

Still, another object/advantage of the invention is to enable the containers to be stacked one on top of another.

FIGURES IN THE DRAWINGS

DETAILED DESCRIPTION OF THE PREFERRED EMBODIMENT

Figure 1:
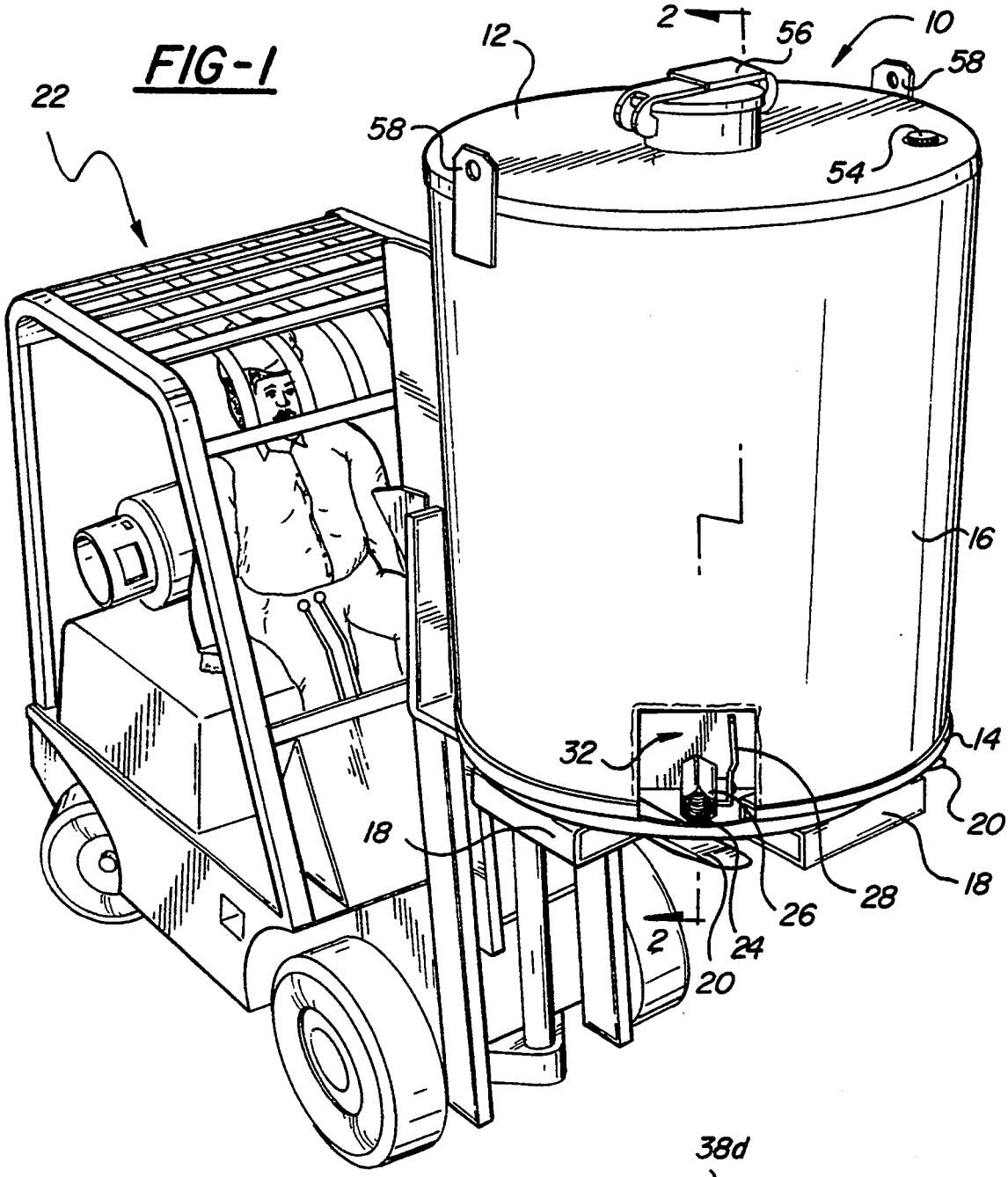
FIG. 1 is a perspective view of the portable container of the present invention being transported by a forklift vehicle.
Figure 4:
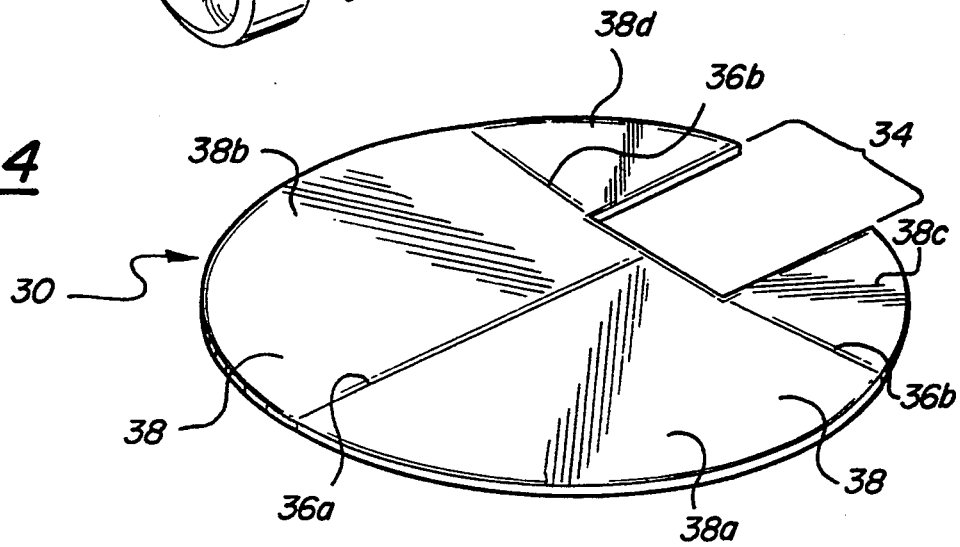
FIG. 4 is a perspective view of the interior false bottom portion of the portable container of the present invention removed from the portable container.

The portable container of the present invention is shown generally at 10 in FIG. 1. The container 10 has a circular top wall portion 12, a circular exterior bottom wall portion 14, and a cylindrical side wall portion 16 extending vertically between the top wall portion 12 and the exterior bottom wall portion 14. The container 10 is preferably made of steel. The container 10 also comprises a plurality of forklift tubes 18 attached to the exterior bottom wall portion 14 for receiving the forks 20 of a forklift vehicle 22 as shown in FIG. 1. The forklift vehicle 22 is used to transport the portable container 10. The side wall portion 16 has drain opening 24 and a valve 26 disposed therein for draining the liquids from the container 10. The valve 26 has a manually operated lever 28 movable between a first position wherein the drain opening 24 is closed and a second position wherein the drain opening 24 is open thereby allowing the liquids contained within the container 10 to drain from the container 10. The container of the present invention is characterized by an interior false bottom 30 abutting the side wall portion 16 and sloping downwardly toward the drain opening 24 for causing complete drainage of the liquids contained within the container 10.

Figure 2:
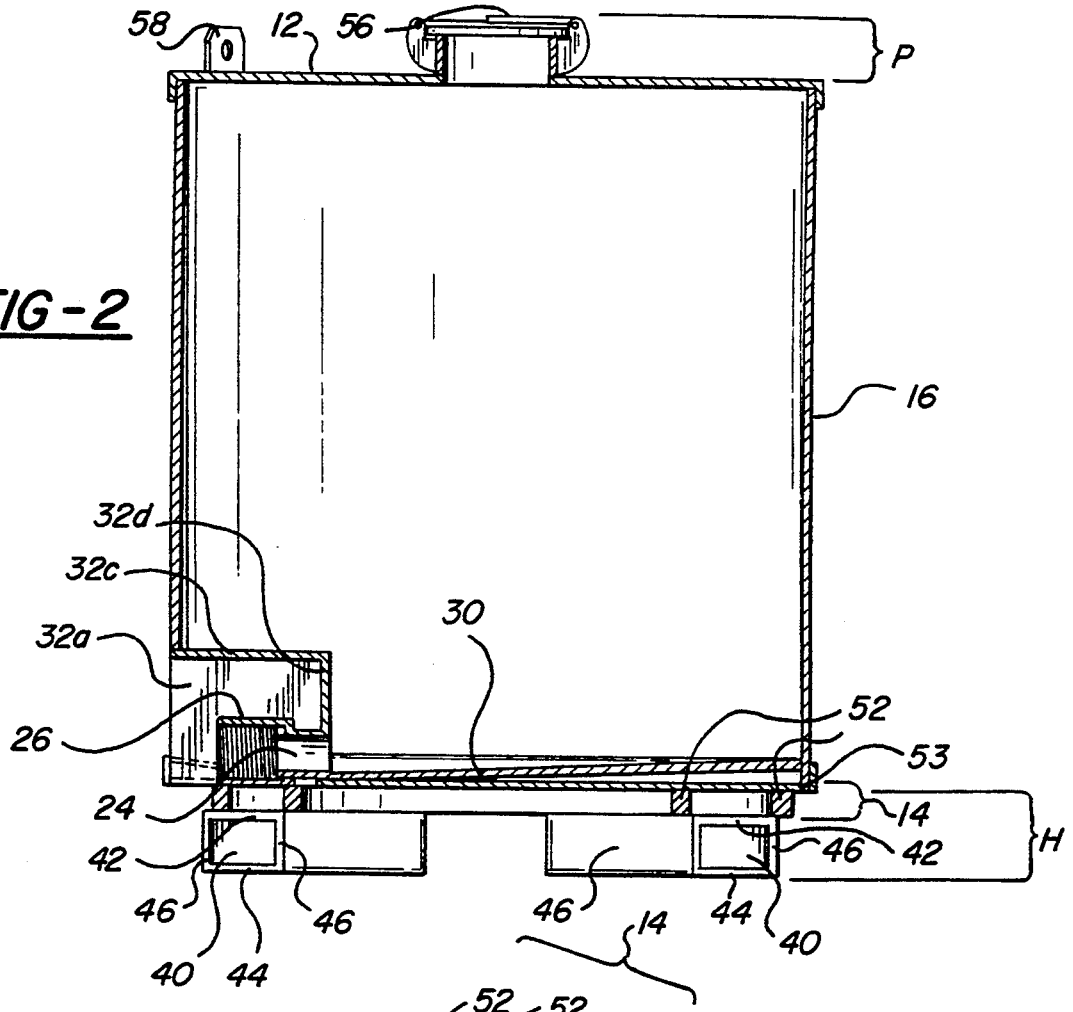
FIG. 2 is a cross-sectional view of the portable container of the present invention taken about line 2—2 of FIG. 1.
Figure 3:
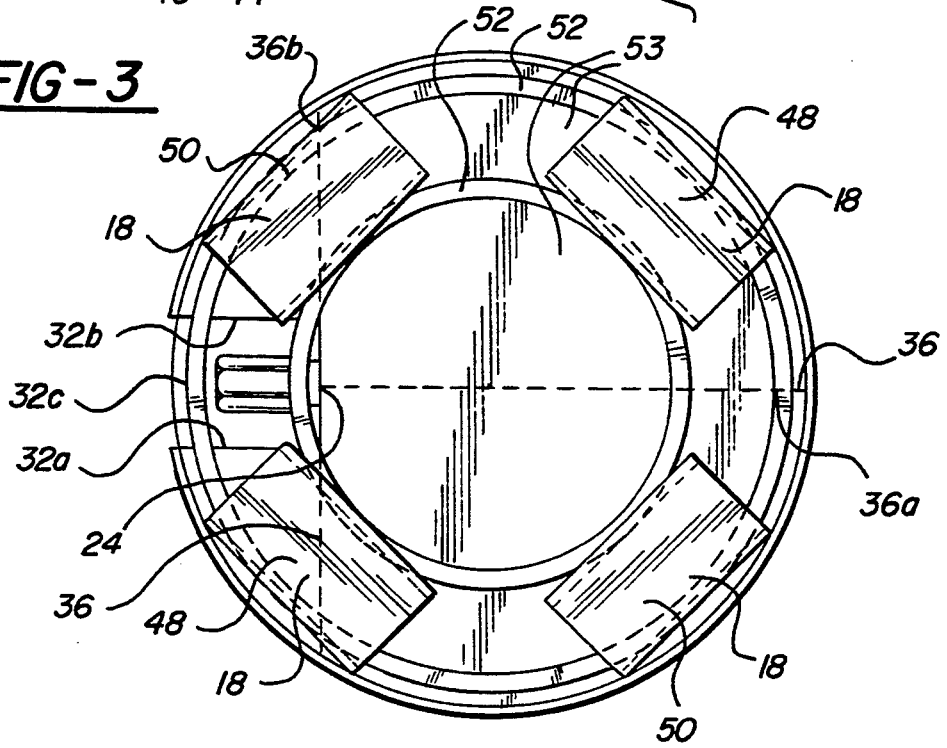
FIG. 3 is a bottom view of the portable container of the present invention depicted in FIG. 1.

Referring to FIGS. 1 and 2, the side wall portion 16 has an indentation 32 for enclosing the valve 26 and lever 28. The valve 26 is positioned within the indentation 32 so that the valve 26 does not protrude beyond the side wall portion 16. In other words, the valve 26 and lever 28 remain disposed within the indentation 32. The indentation 32 extends through the exterior bottom wall portion 14 in the preferred embodiment, as shown in FIGS. 1–4. The indentation 32 is rectangular in shape and comprises walls **32*a*, 32*b*, 32*c*, and 32*d***.

The interior false bottom portion 30 also abuts the indentation 32 and has a cut-out section 34 for receiving the indentation 32. The interior false bottom portion 30 also has at least one crease line 36 extending from the side wall portion 16 through the cutout section 34 and intersecting the drain opening 24. In the preferred embodiment of the present invention, there are two crease lines, first and second crease lines **36*a* and 36*b*. Crease lines 36*a* and 36*b* divide the interior false bottom portion 32 into a plurality of sloped sections 38 comprising main sections 38*a* and 38*b* and tab sections 38*c* and 38*d* which extend from the main sections 38*a* and 38*b*, respectfully, and define the cutout section 34. Tab section 38*c* abuts wall 32*a* of indentation 32 while tab section 38*d* abuts wall 32*b* of indentation 32. The sloped sections 38 slope from the side wall portion 16 downwardly toward each crease line 36 wherein each crease line 36 directs the liquids contained in the container 10 toward the drain opening 24. Specifically, main section 38*a* and tab section 38*c* slope downwardly towards crease line 36a. Likewise, main section 38*b* and tab section 38*d* slope downwardly towards crease line 36*a*. Additionally, tab sections 38*c*, 38*d* and main sections 38*a*, 38*b* slope downwardly towards crease line 36*b*. The downwardly sloping tab sections 38*c* and 38*d* prevent trapping of the liquids located within the container 10 between the tab section 38*c*, wall 32*a* of indentation 32, and side wall portion 16 and between tab section 38*d*, wall 32*b* of indentation 32, and side wall portion 16. The liquids contained in the container 10 propagate by force of gravity to crease lines 36*a* and 36*b* and ultimately to drain opening 24. With the sloped interior false bottom 30 configuration discussed above, the liquids contained within the container 10 can be completely discharged through drain opening 24 without the having to tip the container 10 from its normal upright position as depicted in FIG. 2**.

The forklift tubes 18 of the present invention perform a dual function. The first function is to receive the forks 20 of a forklift vehicle 22. The second function of the forklift tubes 18 is to support the container 10 upon a surface. That is, the forklift tubes 18 act as legs upon which the remainder of the container 10 rests in its normal upright position. The top wall portion 12, exterior bottom wall portion 14, and side wall portion 16 rest on forklift tubes 18 and are supported therewith. The forklift tubes 18 are located within the perimeter of the exterior bottom wall portion 14. The forklift tubes 18 are rectangularly shaped and define a longitudinally extending passageway 40 therein. The forklift tubes 18 comprise a rectangularly shaped upper plate 42, a rectangularty shaped lower plate 44, and two rectangularly shaped side plates 46. The forklift tubes 18 comprise of a first pair of forklift tubes 48 and a second pair of forklift tubes 50, wherein the passageways 40 of the first pair of forklift tubes 48 are oriented in a different direction than the passageways of the second pair of forklift tubes 50 so that the forks 20 of the forklift vehicle 22 can pick up and move the portable container 10 from more than one direction. Specifically, the longitudinally extending passageways 40 of the first pair of forklift tubes 48 are perpendicular to the longitudinally extending passageways 40 of the second pair of forklift tubes 50. The forklift tubes 18 are spaced apart such that each forklift tube 18 is located near, but within, the outer perimeter of the exterior bottom wall portion 14 with the forklift tubes 18 being spaced apart. The forklift tubes 18 provide container 10 with the necessary stability to prevent the container 10 from tipping when resting on a substantially flat surface. The exterior bottom wall portion 14 is circular in shape and has a generally flat surface 53 except for two concentric rings 52 which are spaced apart to support the plurality of forklift tubes 18. The upper plates 42 of the forklift tubes 18 are welded to the concentric rings 52. The concentric rings 52 rest upon the flat surface 53 of exterior bottom wall portion 14 and act as a spacer between the forklift tubes 18 and the bottom of the side wall portion 16.

In the preferred embodiment, the shell or side wall portion 16 is cylindrically shaped and the top wall portion 12 is circular in shape. The top wall portion 12 has at least one fill opening 54 for filling the portable container 10 with the liquids. A manhole hatch 56 is also provided in the middle of the top wall portion 12 for accessing the interior of the portable container 10. A pair of lift lugs 58 are spaced apart and extend upwardly from the side wall portion 16. The lift lugs 58 can be used to lift the container 10 by using a chain and crane arrangement. A height, H, measures the distance that the concentric rings 52 and forklift tubes 18 extend from the flat surface 53 of the exterior bottom wall portion 14. A protrusion distance, P, measures the greatest distance that either the lift lugs 58 or the manhole hatch 56 protrude from the top wall portion 12. In the preferred embodiment, the manhole hatch 56 protrudes further from the top wall portion 12 than the lift lugs 58. In the preferred embodiment, the height, H, is greater than the distance, P. With height, H, being greater than distance, P, a first container 10 can be stacked upon a second identical container such that the lower plate 44 of the forklift tubes 18 of the first container 10 rests upon the top wall portion of the second container. With this arrangement, the manhole hatch of the second container would lie within the concentric rings 52 of the first container 10.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. A portable container (10) for containing liquids, said container (10) comprising:

a top wall portion (12), an exterior bottom wall portion (14), and a side wall portion (16) extending vertically between said top wall portion (12) and said exterior bottom wall portion (14);

a plurality of forklift tubes (18) attached to said exterior bottom wall portion (14) for receiving the forks (20) of a forklift vehicle (22) whereby the forklift vehicle (22) is used to transport said portable container (10);

said side wall portion (16) having a drain opening (24) and a valve (26) disposed therein for draining the liquids from said container (10);

an interior false bottom portion (30) abutting said side wall portion (16) and sloping downwardly toward the drain opening (24) for causing complete drainage of the liquids contained within said container (10);

said side wall portion (16) having an indentation (32) for enclosing said drain opening (24) and said valve (26);

said interior false bottom portion (30) having a cut-out section (34) for receiving said indentation (32); and characterized by said interior false bottom portion (30) having at least one crease line (36) extending from said side wall portion (16) to said cut-out section (34) and intersecting said drain opening (24).

2. A portable container (10) as set forth in claim 1 further characterized by each of said crease lines (36) dividing said interior false bottom portion (30) into a plurality of sloped sections (38) sloping downwardly from said side wall portion (16) toward each of said crease lines (36) wherein each of said crease lines (36) directs the liquids contained in said container (10) toward said drain opening (24).

3. A portable container (10) for containing liquids, said container (10) comprising:

a top wall portion (12), and exterior bottom wall portion (14), and a side wall portion (16) extending vertically between said top wall portion (12) and said exterior bottom wall portion (14);

a plurality of forklift tubes (18) attached to said exterior bottom wall portion (14) for receiving the forks (20) of a forklift vehicle (22) whereby the forklift vehicle (22) is used to transport said portable container (10);

said side wall portion (16) having a drain opening (24) and a valve (26) disposed therein for draining the liquids from said container (10);

an interior false bottom portion (30) abutting said side wall portion (16) and sloping downwardly toward said drain opening (24) for causing complete drainage of the liquids contained within said container (10); and characterized by said exterior bottom wall portion (14) including two concentric rings (52) spaced apart to support said plurality of forklift tubes (18).

4. A portable container (10) for containing liquids, said container (10) comprising a circular top wall portion (12); a circular exterior bottom wall portion (14); a cylindrical side wall portion (16) extending vertically between said top wall portion (12) and said exterior bottom wall portion (14); a plurality of forklift tubes (18) attached to said exterior bottom wall portion (14) for receiving the forks (20) of a forklift vehicle (22) whereby the forklift vehicle (22) is used to transport said portable container (10); said side wall portion (16) having a drain opening (24) and a valve (26) disposed therein for draining the liquids from said container (10); an indentation (32) in said side wall portion (16) for enclosing said drain opening (24) and said valve (26); a circular interior false bottom portion (30) abutting said side wall portion (16) and said indentation (32); said interior false bottom portion (30) having first (**36*a*) and second (36*b*) crease lines extending from said side wall portion (16) and intersecting said drain opening (24), said first and second crease lines (36*a*,36*b*) dividing said interior false bottom portion (30) into a plurality of sloped sections (38) comprising main sections (38*a*,38*b*) and tab sections (38*c*,38*d*) extending from said main sections (38*a*,38*b*); said main sections (38*a*,38*b*) and said tab sections (38*c*,38*d*) sloping downwardly from said side wall portion (16) to said first crease line (36*a*), said main sections (38*a*,38*b*) sloping downwardly from said side wall portion (16) to said second crease line (36*b*), and characterized by said tab sections (38*c*,38*d*) sloping downwardly from said side wall portion (16) to said second crease line (36*b*) to cause the liquids contained within said container (10) to propagate by force of gravity toward said first and second crease lines (36*a*,36*b*) and to said drain opening (24) thereby causing complete drainage of said container (10) without tipping said container (10**).

* * * * *